US006623622B2

(12) United States Patent
Gupta

(10) Patent No.: US 6,623,622 B2
(45) **Date of Patent: *Sep. 23, 2003**

(54) TWO STAGE DIESEL FUEL HYDROTREATING AND STRIPPING IN A SINGLE REACTION VESSEL

(75) Inventor: Ramesh Gupta, Berkeley Heights, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/960,015

(22) Filed: Sep. 21, 2001

(65) Prior Publication Data

US 2002/0074262 A1 Jun. 20, 2002

Related U.S. Application Data

(60) Provisional application No. 60/239,223, filed on Oct. 10, 2000.

(51) Int. Cl.[7] ..... C10G 65/02; C10G 65/04

(52) U.S. Cl. ..... 208/59; 208/58; 208/89; 208/210

(58) Field of Search ..... 208/58, 59, 210, 208/89

(56) References Cited

U.S. PATENT DOCUMENTS

| | | | | |
|---|---|---|---|---|
| 4,243,519 A | | 1/1981 | Schorfheide | 208/210 |
| 5,705,052 A | | 1/1998 | Gupta | 208/57 |
| 5,720,872 A | | 2/1998 | Gupta | 208/57 |
| 5,928,497 A | | 7/1999 | Iaccino | 208/212 |
| 5,968,346 A | | 10/1999 | Jung et al. | 208/210 |
| 5,985,135 A | | 11/1999 | Gupta | 208/212 |
| 6,017,443 A | | 1/2000 | Buchanan | 208/210 |
| 6,264,828 B1 | * | 7/2001 | Baker et al. | 208/100 |

FOREIGN PATENT DOCUMENTS

| | | | |
|---|---|---|---|
| EP | 0553920 A1 | 4/1993 | C10G/49/00 |

* cited by examiner

*Primary Examiner*—Nadine G. Norton
(74) *Attorney, Agent, or Firm*—Gerard J. Hughes; Jeremy J. Kliebert

(57) ABSTRACT

A diesel fraction is purified by a process having two reaction stages and a stripping stage in a single vessel. Heteroatoms are removed in the first stage, to permit the use of a sulfur sensitive aromatics saturation catalyst in the second stage, to produce a purified diesel stock. The first stage liquid effluent is stripped in a stripping stage and then passed into the second reaction stage, in which it reacts with fresh hydrogen for aromatics removal. The second reaction stage produces a hydrogen-rich vapor effluent, which may provide all or a portion of the first stage reaction hydrogen. A noble metal catalyst is employed in the second stage. The diesel feed for the process may be one that has been at least partially refined with respect to either or both heteroatom or aromatics removal.

20 Claims, 1 Drawing Sheet

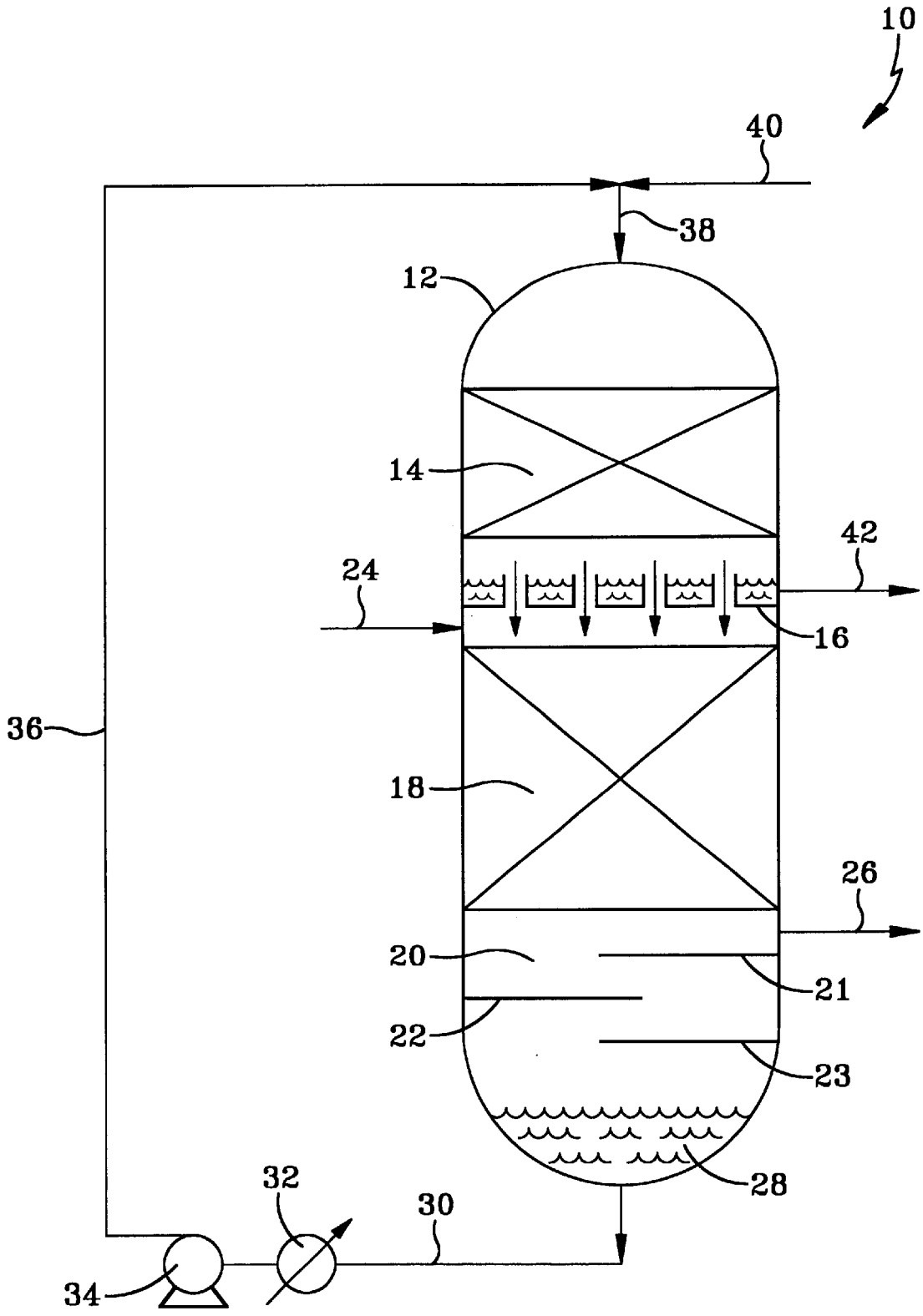
10
40
38
12
14
42
24
16
36
18
26
20
21
22
23
28
32
30
34

TWO STAGE DIESEL FUEL HYDROTREATING AND STRIPPING IN A SINGLE REACTION VESSEL

CROSS REFERENCE TO RELATED APPLICATION

This case claims benefit of U.S. Provisional Application No. 60/239,223 filed Oct. 10, 2000.

BACKGROUND OF THE INVENTION

1. Field of the Invention

The invention relates to a two stage catalytic process with stripping, in a single reaction vessel, for purifying a diesel fuel stock. More particularly, the invention relates to a process for selectively removing sulfur and nitrogen compounds from a diesel fuel stock with hydrogen, in a first reaction stage, to produce a sulfur and nitrogen reduced liquid effluent, which is then stripped in a stripping stage and passed into a second reaction stage, in which it reacts with fresh hydrogen in the presence of a catalyst selective for aromatics saturation, to produce a diesel fuel stock reduced in sulfur, nitrogen and aromatics. The reaction and stripping stages are all in the same reaction vessel.

2. Background of the Invention

Many hydrocarbon feeds useful for producing diesel fuel stocks contain undesirable components which must be removed or converted to meet fuel specifications. These components include heteroatoms such as sulfur, nitrogen and oxygen, aromatic unsaturates, halides, and metals. In conventional diesel fuel hydrotreating processes, heteroatom compounds and often aromatic unsaturates are removed from the feed by reacting it with hydrogen in the presence of one or more catalysts. Various conventional process configurations have been developed which use multiple vessels as disclosed, for example, in U.S. Pat. Nos. 5,705,052; 5,720,872; 5,968,346 and 5,985,135.

Specifications for diesel fuels with respect to such undesirable components, particularly sulfur and nitrogen, and also aromatics, are increasingly stringent. Consequently, more upgrading is required to reduce the amount of these components in the diesel stock to the lower levels required by the more stringent specifications. Moreover, as the availability of clean feeds for producing diesel continues to decrease, petroleum refiners will need to rely more heavily on relatively high boiling feeds derived from such materials as coal, tar sands, shale oil, and heavy crudes. Such high boiling feeds typically contain significant amounts of undesirable components. Refiners must therefore not only further reduce the levels of these components in diesel stocks, but must also deal with feeds having higher concentrations of undesirable components. Conventional diesel hydrotreating facilities may therefore have difficulty meeting increasingly stringent diesel specifications, a difficulty that may be further exacerbated by the poorer quality of available feeds.

Factors such as space constraints, which limit or prevent adding additional reaction vessels, strippers, and associated utilities, may impede the construction of new, grass-roots diesel fuel hydroprocessing equipment to increase the purity of the diesel fuel stock, the capacity for diesel stock production, or both. There is therefore a need for cost effectively increasing the purity of a diesel fuel stock produced in an existing diesel fuel processing facility, the facility's production capacity, or both, without having to add multiple hydrotreating reaction vessels and strippers, for the required hydrotreating reactions and stripping.

SUMMARY OF THE INVENTION

In one embodiment, the invention is a process for removing heteroatom compounds and aromatic unsaturates from a hydrocarbon feed boiling in the diesel fuel range comprising:

(a) passing said feed and hydrogen into a first reaction stage, in which they react in the presence of a catalytically effective amount of a first catalyst selective for removal of heteroatom compounds under first catalytic conversion conditions, to produce a first stage effluent comprising (i) a liquid boiling in the diesel fuel range reduced in heteroatom compounds and (ii) a vapor containing vaporous heteroatom species produced by the reaction;

(b) separating said first stage liquid and vapor effluents;

(c) stripping said first stage liquid effluent in a stripping stage to remove dissolved heteroatom species produced by said first stage reaction;

(d) passing said stripped liquid into a second reaction stage, where the stripped liquid reacts with fresh hydrogen or a fresh hydrogen treat gas under second stage catalytic conversion conditions, in the presence of a second catalyst selective for aromatics removal, to remove aromatic compounds and produce second stage liquid and vapor effluents, wherein said vapor contains unreacted hydrogen and said liquid comprises a diesel boiling-range hydrocarbon having a heteroatom and aromatics content lower than that of said feed;

(e) separating the second stage liquid and vapor effluents and recovering said second stage liquid effluent; and (f) passing said second stage vapor effluent into said first stage, said two reaction stages and said stripping stage being in a common vessel.

In another embodiment, the invention is a method for upgrading an existing diesel hydrotreating facility comprising one or more reaction vessels, strippers and associated equipment and which produces a hydroprocessed diesel fraction, said method comprising:

(a) reacting said hydroprocessed diesel fraction feed and hydrogen in a first reaction stage under first catalytic conversion conditions in the presence of a first catalyst selective for removal of heteroatom compounds, to produce a first stage effluent comprising (i) a liquid effluent containing a diesel fraction reduced in heteroatom compounds and (ii) a vapor effluent containing vaporous heteroatom species produced by the reaction;

(b) separating said first stage liquid and vapor effluents;

(c) stripping said first stage liquid effluent in a stripping stage to remove dissolved heteroatom species produced by said first stage reaction;

(d) passing said stripped liquid into a second reaction stage, in which it reacts with fresh hydrogen or a fresh hydrogen treat gas under second stage catalytic conversion conditions, in the presence of a second catalyst selective for aromatics removal, to remove aromatic compounds and produce second stage liquid and vapor effluents, wherein said vapor effluent contains unreacted hydrogen and said liquid effluent contains a diesel boiling-range hydrocarbon fraction having a heteroatom and aromatics content lower than that of said hydroprocessed diesel fraction fed into the first reaction stage;

(e) separating said second stage liquid and vapor effluents and recovering said liquid effluent; and (f) conducting said second stage vapor effluent to said first stage, said two reaction stages and said stripping stage being in a common vessel.

BRIEF DESCRIPTION OF THE DRAWING

The FIGURE schematically illustrates a flow diagram of an embodiment of the invention using two cocurrent, downflow reaction stages and a stripping stage, all in the same vessel.

DETAILED DESCRIPTION

The invention is based on the discovery of a hydroprocessing process employing a single vessel having two catalytic reaction stages, with interstage stripping in a stripping stage, for removing heteroatom compounds (hereinafter "heteroatoms") and aromatic unsaturates (hereinafter "aromatics") from a diesel fraction. Each reaction stage produces both a liquid and a vapor effluent, and employs cocurrent downflow of the diesel fraction feed and hydrogen reactants. By heteroatoms is meant primarily sulfur and nitrogen, although oxygenates may also be removed. Most of the heteroatom compounds in the feed are removed in the first reaction stage, which comprises a catalyst selective for heteroatom removal.

In one embodiment, the second reaction stage comprises a catalyst selective for removing aromatics, heteroatoms or both, and preferably one that is selective for removing aromatics. The liquid and vapor effluent from each reaction stage are separated. The liquid and vapor effluents formed in the first reaction stage are passed into the stripping stage. In the stripping stage, the first reaction stage vapor, which contains most of the undesirable heteroatom reaction products produced by the reaction of the feed with the hydrogen, separates from the liquid. The liquid is stripped of dissolved heteroatom reaction products and collects in the bottom of the vessel, from which it is removed and then passed as feed up into the second stage. The heteroatoms removed in the first reaction stage form primarily $H_2S$ and $NH_3$, some of which are dissolved in the first stage liquid effluent. Stripping the first stage liquid effluent at least partially removes these dissolved species before it is conducted to the second stage. In the stripping stage, the downflowing first stage liquid effluent contacts a suitable upflowing stripping gas. Aromatics are removed in the second stage by saturation with hydrogen. The second stage liquid and gaseous effluents are separated. The second stage liquid effluent comprises the heteroatom and aromatics reduced feed, which now comprises a highly purified diesel stock product. The aromatics removal catalyst reaction stage, or second reaction stage, is preferably located in the upper portion of the vessel, above the first reaction stage. Removing most of the heteroatoms from the diesel fraction feed in the first reaction stage, enables the use of a more active and sulfur sensitive catalyst, such as a noble metal catalyst, for the second reaction stage aromatics removal. The stripping stage is preferably located in the bottom of the vessel, below the first reaction stage. Diesel hydrotreating plants are often operated at a relatively low pressure, while aromatics saturation is preferably achieved at higher pressures. Therefore, when operated at high pressure for aromatics saturation, the present invention provides an ideal add-on to an existing low pressure diesel hydrotreating plant, to produce a product liquid of greater purity while reducing investment cost by adding or replacing only a single vessel.

The diesel fraction contained in the feed for the present process, may be one which has not been previously processed or treated (e.g., hydrotreated) to remove heteroatoms and aromatics, or it may be one which has already been at least partially refined and purified, with respect to heteroatom removal, aromatics removal, or both, and may come directly from an existing diesel fuel plant, from storage (tankage), or both. While the preferred process and vessel may be employed to increase the capacity of an existing system or plant, increase product purity, or both, it is preferred that they be used to at least increase the purity of the diesel fraction, to produce a more highly purified stock, to meet more stringent specifications requiring lower levels of heteroatom compounds and aromatics than conventional hydroprocessing methods typically achieve. In one embodiment, the product formed (referred to herein as "purified stock," "blendstock," or "diesel stock") may be used for, e.g., blending, combing with an additive package, or both, to produce a diesel fuel. By diesel fraction is meant any fuel fraction generally boiling in the diesel fuel range and includes both jet fuel and diesel fuel fractions. Employing a single vessel containing all three stages provides an economically advantageous way of improving the purity of a diesel fraction produced by existing hydroprocessing facilities; to increase the refinery capacity for diesel stock; to provide a high pressure unit to a low pressure plant; and combinations thereof.

In one embodiment the invention comprises a process employing two reaction stages for removing heteroatom compounds and aromatic unsaturates from a feed comprising a hydrocarbon distillate boiling in the diesel fuel range. The process comprises:

(a) passing the feed and hydrogen into a first reaction stage, in which they react in the presence of a catalyst selective for removal of heteroatom compounds, to produce a first stage effluent comprising (i) a hydrocarbon liquid boiling in the diesel range reduced in heteroatom compounds and (ii) a vapor containing vaporous heteroatom species produced by the reaction;

(b) separating the first stage liquid and vapor effluents;

(c) stripping the first stage liquid effluent in a stripping stage to remove dissolved heteroatom species produced by the first stage reaction;

(d) passing the stripped liquid into a second reaction stage, in which it reacts with fresh hydrogen or a fresh hydrogen treat gas, in the presence of a catalyst effective for aromatics removal, to remove aromatic compounds and produce second stage liquid and vapor effluents, wherein the vapor affluent contains unreacted hydrogen and the liquid comprises a diesel fuel stock having a heteroatom and aromatics content lower than that of the feed;

(e) separating the second stage liquid and vapor effluents and recovering the liquid as diesel stock product; and (f) passing the second stage vapor effluent into the first stage, and wherein the two reaction stages and the stripping stage are all in the same vessel.

The second stage vapor effluent will preferably supply at least a portion of the first stage reaction hydrogen required for the heteroatom removal. Further embodiments include the second reaction stage located proximate the top of the vessel, with the first reaction stage located in the vessel below the second reaction stage, and the stripping stage located below the first reaction stage. It is preferred that the second reaction stage comprise a catalyst selective for aromatics removal, such as a sulfur sensitive noble metal catalyst. If desired, all or a portion of the second stage catalyst may also comprise a catalyst effective for heteroatom (sulfur and nitrogen) removal or a mixture of heteroatom and aromatics removal catalysts. Still further embodiments include a noble metal catalyst in the second stage for aromatics saturation and operating the vessel at a pressure of at least about 850 psia and preferably at least 950 psia, for more efficient aromatics removal. This is a preferred embodiment. It is also preferred that the feed comprise a diesel fraction that has been at least partially treated for heteroatom removal. Still further embodiments include the presence of one or more of indirect heat exchange cooling and quenching in either or both reaction stages, if needed, for temperature control and to maximize liquid yield. A still further embodiment includes adding all of the reaction hydrogen as fresh hydrogen into the second stage. In this embodiment, the hydrogen-rich second stage vapor will contain all the hydrogen required for the first reaction stage.

In yet a further embodiment, the invention comprises a method for upgrading an existing diesel hydrotreating facility or system comprising one or more reaction vessels, strippers and associated equipment and produces a hydrotreated diesel fraction reduced in heteroatom and aromatic compounds, which comprises the feed for the upgrading, wherein the method comprises:

(a) passing the hydrotreated diesel fraction feed and hydrogen into a first reaction stage in which they react in the presence of a catalyst selective for removal of heteroatom compounds, to produce a first stage effluent comprising (i) a liquid diesel fraction reduced in heteroatom compounds and (ii) a vapor containing vaporous heteroatom species produced by the reaction;

(b) separating the first stage liquid and vapor effluents;

(c) stripping the first stage liquid effluent in a stripping stage to remove dissolved heteroatom species produced by the first stage reaction;

(d) passing the stripped liquid into a second reaction stage, in which it reacts with fresh hydrogen or a fresh hydrogen treat gas, in the presence of a catalyst selective for aromatics removal, to remove aromatic compounds and produce second stage liquid and vapor effluents, wherein the vapor effluent contains unreacted hydrogen and the liquid comprises a diesel fraction having a heteroatom and aromatics content lower than that of the diesel fraction fed into the first reaction stage;

(e) separating the second stage liquid and vapor effluents and recovering the liquid as diesel stock product, and (f) passing the second stage vapor effluent into the first stage, wherein the two reaction stages and the stripping stage are all in the same vessel, and wherein the vessel has been added to, or has replaced a vessel in, an existing hydrotreating facility.

By upgrading an existing diesel hydrotreating system or facility is meant (i) reducing the heteroatom and aromatics content of the hydrotreated diesel fraction, (ii) increasing the amount of diesel fraction that can be processed, or both and preferably at least reducing the heteroatom and aromatics content of the diesel fraction. The further embodiments referred to above also apply to this embodiment.

As discussed, the feed for the present process comprises a hydrocarbon fraction boiling generally in the diesel and jet fuels range of from about 400° F. to 650° F., which may or may not have been previously hydrotreated or otherwise processed to remove at least heteroatoms. As used in the context of the invention, a diesel stock is a diesel fraction which has been hydrotreated according to the process of the invention, at least with respect to heteroatom removal and preferably reduced in both heteroatoms and aromatics. It is preferred to use an at least partially refined diesel fraction as the feed to the hydrotreating vessel of the invention. The sulfur content of the diesel fraction or stock feed may vary, but will typically have less than 500 wppm sulfur, in the form of various sulfur bearing compounds and preferably less than 400 wppm of sulfur. The nitrogen content of the feed will range from about 20 to 1000 wppm, respectively and preferably no more than 300 wppm. By way of an illustrative, but nonlimiting example, the respective sulfur and nitrogen contents of a diesel fraction that has been purified according to the process of the invention may range from about 5–100 wppm and 10–100 wppm, respectively, depending on the impurity level in the feed. The stripping and reaction stages in the vessel in the practice of the present invention are operated at substantially the same pressure. This pressure may be a relatively low pressure of less than 600 psia, but it is preferred to operate the vessel at a pressure of at least about 850 psia, more preferably at least about 950 psia and still more preferably at least about 1000 psia for aromatics saturation. The reaction temperature in the first and second reaction stages may broadly range from about 350–850° F., with 600–700° F. being typical. A high pressure enables the use of a more active (e.g., noble metal) catalyst, as compared to a less active (e.g., nickel) catalyst, which would require a substantially greater amount of catalyst and concomitantly larger vessel.

The terms "hydroprocessing" and "hydrotreating" are sometimes used synonymously. However, hydroprocessing is regarded by many as having a broader meaning, which includes hydrotreating as one type of hydroprocessing. As used herein, hydrotreating refers to a process wherein a feed to be hydrotreated and a hydrogen-containing treat gas react in the presence of one or more suitable catalysts primarily active (selective) for the removal of heteroatoms, such as sulfur, and nitrogen, and for the saturation of aromatics by hydrogen. Suitable hydrotreating catalysts include any conventional hydrotreating catalyst. Illustrative, but nonlimiting examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. As mentioned above, it is within the scope of the present invention that more than one type of hydrotreating catalyst may be used in the same reaction stage or zone. Catalysts useful for saturating aromatics include nickel, cobalt-molybdenum, nickel-molybdenum, nickel-tungsten and noble metal (e.g., platinum and/or palladium) catalysts, with the noble metal catalysts being sulfur sensitive, but more selective for aromatics removal.

In one embodiment, the aromatics saturation catalyst reaction stage, or second reaction stage, is preferably located in the upper portion of the vessel, above the first reaction stage. Once-through, fresh hydrogen or hydrogen treat gas is introduced into the top of the second reaction stage. The aromatics are removed by saturation. For many applications it is preferred that the hydrogen introduced into the second stage be sufficient to provide all of the reaction hydrogen for both the second and first reaction stages. However, in some cases a source of hydrogen sufficiently low in sulfur and nitrogen may be available which is not pure enough for the second stage, but may be useable in the first stage. In this case, all or a portion of the first stage reaction hydrogen may be separately introduced into the first stage. This will reduce the amount of fresh hydrogen required for the second stage. A conventional chimney and tray type of gas-liquid separation means, or equivalent, may be located between these two reaction stages, with the separated, second reaction stage gaseous effluent passing from the separation means directly down into the top of the first reaction stage below, without the need for a gas compressor. The separated second stage liquid comprises the purified diesel stock product, which now has an aromatics and heteroatom content lower than that in the diesel fraction feed passed into the vessel for further purification. A pressure differential between stages provides the driving force for the hydrogen rich second stage gaseous effluent to pass down into and through the first reaction stage below. The diesel distillate fraction to be purified or more highly purified is introduced into the top of the first reaction stage, in which it reacts with fresh hydrogen or a fresh hydrogen treat gas, in the presence of a catalyst selective for heteroatom removal, to produce a diesel stock reduced in heteroatom compounds. When these features are present, they permit, in one embodiment, the use of a single, and relatively small and space efficient reaction vessel to be added to, or replace a vessel in, an existing diesel refining facility in a refinery, and with minimal or no additional gas compression capacity. The choice of catalyst is not critical. For example, nickel or nickel and molybdenum or any other sulfur and nitrogen removal catalyst may be used. While all of the first stage reaction hydrogen may come from the second stage vapor effluent, all or a portion of the hydrogen for the first stage may be separately added directly into the first stage. This may be useful in the case in which a source of hydrogen is available which, while not pure enough for the second stage aromatics saturation, may have a $H_2S$, $NH_3$, or combined $H_2S$ and $NH_3$ content low enough not to adversely interfere with the first stage feed sulfur and nitrogen removal. The heteroatoms are typically removed as gaseous heteroatom species comprising $H_2S$ and $NH_3$, along with $H_2O$ vapor (hereinafter "gaseous heteroatom species") if oxygenates are present in the feed. Also, instead of using a second stage catalyst selective for aromatics removal, the second stage catalyst could be the same or different desulfurization catalyst used in the first stage, to produce a product liquid having a very low level of sulfur or a mixture of a heteroatom and aromatics removal catalysts. However, it is preferred that the second stage catalyst comprise one that is selective for aromatics removal and not heteroatom removal.

In the context of the invention, the terms "fresh hydrogen" and "fresh hydrogen-containing treat gas" are synonymous, and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the reactor. The treat gas stream introduced into a reaction stage will preferably contain at least about 50 vol. %, more preferably at least about 75 vol. % hydrogen.

Most of the heteroatom compounds are removed from the feed in the first reaction stage, which produces liquid effluent having a lower heteroatom than the feed. The first stage also produces a gaseous effluent comprising any unreacted hydrogen, hydrogen treat gas diluent, gaseous heteroatom species, and minor amounts of gaseous (e.g., $C_{3-}$ and mostly methane) hydrocarbons produced by the reaction. The first stage liquid and gas effluents pass out of the first reaction stage and into a stripping stage below, in which the heteroatom-containing gas is separated from the liquid and in which the downflowing liquid contacts an upflowing stripping gas, to strip out residual $H_2S$, $NH_3$ and $H_2O$ vapor from the liquid. The stripping gas mixes with the first reaction stage gaseous effluent to form a gaseous mixture, which is removed from the vessel and sent to disposal or further processing. The heteroatom reduced liquid diesel fraction collects in a space proximate to the bottom of the interior of the vessel, from where it is removed, cooled if necessary, and passed back up as the feed for the second reaction stage. If desired, an external gas-liquid separation drum may be used, but it is preferred that separation occur in the bottom portion of the reaction vessel. Removing the heteroatoms from the diesel fraction feed first, enables the use of a more highly active aromatics saturation catalyst in the second stage, such as a noble metal catalyst which would be sensitive to deactivation by heteroatom compounds, which in turn, permits the use of a less catalyst for the aromatics removal. Spent hydrogen treat gas, vaporous heteroatom species and other vaporous reaction products (e.g., minor amounts of $C_{3-}$ hydrocarbons and mostly methane) mix with the upflowing stripping gas and the mixture is removed from the vessel proximate the top of the stripping stage.

The invention can be further understood with reference to the FIGURE, which is a schematic flow diagram of a diesel fraction purifying unit, an embodiment of the invention, comprising two different and consecutive cocurrent downflow reaction stages, with a vapor-liquid separating means placed between the second and first reaction stages, a stripping stage located below the first reaction stage and the bottom portion of the vessel used for collection of the first reaction stage liquid effluent, all in a single reactor vessel. For the sake of simplicity, not all process reaction vessel internals, valves, pumps, heat transfer devices etc. are shown. Thus, a diesel fraction hydrotreating purifying unit 10 comprises a single, hollow, cylindrical metal reactor vessel 12, containing within respective first and second reaction stages defined by fixed catalyst beds 18 and 14, separated by a chimney-type of gas-liquid separation tray 16 within. Catalyst beds 14 and 18 respectively comprise the aromatics saturation and heteroatom removal reaction stages. A vapor-liquid contacting stage 20 comprises the stripping stage and is shown disposed below the first reaction stage 18, in which heteroatom compounds are removed from the diesel fraction feed. Stripping stage 20 is schematically shown by three stripping trays 21, 22 and 23, although packing may be used in place of trays, as is known. The heteroatom and aromatics-containing diesel fraction to be further purified, enters the first reaction stage 12 via feed line 24. The hydrogen-rich vapor effluent from the second reaction stage is separated from the purified diesel fraction by gas permeable gas-liquid separation means 16 and passes down through into the first reaction stage. Such trays are conventional and typically comprise a metal disk provided with a plurality of pipes or chimneys extending therethrough, a bubble cap tray and the like, which permit the hydrogen-rich vapor to pass down through the tray 16, and into the first reaction stage below. This hydrogen-rich vapor passes down into catalyst bed 18, in which the unreacted hydrogen in it reacts with the downflowing diesel fraction to remove heteroatom compounds. Preferably, most of the heteroatom compounds in the feed passed into the first stage are removed in this stage. This produces an effluent comprising a liquid diesel fraction of reduced heteroatom content, along with a vapor which contains $H_2S$, $NH_3$, possibly $H_2O$ vapor, any diluent (e.g., methane, nitrogen and the like) that may have been present in the hydrogen treat gas, and any minor amounts of gaseous hydrocarbons produced by the reaction. The first stage liquid effluent then passes down through stripping stage 20 below, in which is contacts an upflowing stripping gas, which may be hydrogen, steam, methane and the like, which strips out of the downflowing liquid, dissolved heteratom species formed by the first stage reaction. The upflowing stripping gas mixes with the first reaction stage vapor effluent, with the mixture then passing out of the reactor vessel via line 26. This gas mixture is then further processed downstream to remove the sulfur and nitrogen for disposal. The stripped first reaction stage liquid effluent 28 collects in the hollow bottom of the reactor vessel, as shown. This liquid is withdrawn from the bottom of the vessel via line 30, passes through an indirect heat exchanger 32 if required, and then to liquid pump 34 which passes it up, via lines 36 and 38, into the top of the vessel 12, and down into the second reaction stage 14 below. Preferably, the heteroatom content of the stripped liquid should be regulated so that the second stage catalyst or reaction is not adversely affected. Fresh hydrogen or hydrogen treat gas is introduced, via lines 40 and 38, into the top of vessel 12 over the second reaction stage 14. The hydrogen is present in an amount sufficient to supply the reaction hydrogen needed for both reaction stages. The hydrogen mixes with the heteroatom-reduced diesel fraction and reacts with aromatics in it in the presence of the noble metal catalyst, to remove aromatics by saturation. Those skilled in the art will appreciate that some minor amount of additional sulfur and nitrogen may also be removed in the second stage. This produces a second reaction stage liquid effluent comprising the purified diesel stock product, which now has a heteroatom and aromatics content less than that in the diesel fraction feed introduced into the reactor via line 24. It also produces the hydrogen-rich second stage vapor effluent, which after being separated from the liquid via means 16, is passed down into the first reaction stage. The purified diesel stock is removed from the reactor via line 42. The purified diesel stock may be, for example, sent to storage, used for blending combined with an appropriate additive package to form a completed fuel, and combinations thereof. In some embodiments, it may be advantageous to fractionate or strip the purified stock to remove light ends prior to, e.g., blending, storage or combining with an additive package. In an embodiment in which the vessel of the invention is added to an existing facility, such fractionation and stripping capacity may be and typically is present in the existing facility.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A process for removing heteroatom compounds and aromatic unsaturates from a hydrocarbon feed boiling in the diesel fuel range comprising:

a) passing said feed and hydrogen into a first reaction stage operated in a cocurrent manner, in which they react in the presence of a catalytically effective amount of a first catalyst selective for removal of heteroatom compounds under first catalytic conversion conditions, to produce a first stage effluent comprising (i) a liquid boiling in the diesel fuel range reduced in heteroatom compounds and (ii) a vapor containing vaporous heteroatom species produced by the reaction;

b) passing said first stage effluent to a stripping stage wherein it is contacted with a stripping gas to form a stripped first stage liquid effluent and a stripping stage vapor effluent comprised of the first reaction stage vapor and said stripping gas;

c) removing said stripping stage vapor effluent;

d) passing said stripped liquid into a second reaction stage reaction stage operated in a cocurrent manner, where the stripped liquid reacts with hydrogen treat gas under second stage catalytic conversion conditions, in the presence of a second catalyst selective for aromatics removal, to remove aromatic compounds and produce second stage liquid and vapor effluents, wherein said vapor contains unreacted hydrogen and said liquid comprises a diesel boiling-range hydrocarbon having a heteroatom and aromatics content lower than that of said feed;

e) separating the second stage liquid and vapor effluents and recovering said second stage liquid effluent; and f) passing said second stage vapor effluent into said first stage, said two reaction stages and said stripping stage being in a common vessel.

2. A process according to claim 1 wherein said second stage vapor effluent supplies at least a portion of said hydrogen required for said first stage reaction.

3. A process according to claim 2 wherein said first and second stages operate at a pressure of at least 850 psia.

4. A process according to claim 3 wherein said second stage is located above said first stage and said second stage vapor is passed directly from said second stage, down into said first stage.

5. A process according to claim 4 wherein said stripping stage is located below said first reaction stage.

6. A process according to claim 5 wherein said second stage contains a catalyst comprising a noble metal catalytic component for aromatics removal.

7. A process according to claim 6 wherein said second stage also removes heteroatom compounds.

8. A process according to claim 7 wherein said first and second stages operate at a pressure of at least 950 psia.

9. A process according to claim 8 wherein said second stage vapor effluent supplies all of the hydrogen for said first stage for said heteroatom removal.

10. A method for upgrading an existing diesel hydrotreating facility comprising one or more reaction vessels, strippers and associated equipment and which produces a hydroprocessed diesel fraction, said method comprising:

a) reacting said hydroprocessed diesel fraction feed and hydrogen in a first reaction stage operated in a cocurrent manner under first catalytic conversion conditions in the presence of a first catalyst selective for removal of heteroatom compounds, to produce a first stage effluent comprising (i) a liquid effluent containing a diesel fraction reduced in heteroatom compounds and (ii) a vapor effluent containing vaporous heteroatom species produced by the reaction;

b) passing said first stage effluent to a stripping stage wherein it is contacted with a stripping gas to form a stripped first stage liquid effluent and a stripping stage vapor effluent comprised of the first reaction stage vapor and said stripping gas;

c) removing said stripping stage vapor effluent;

d) passing said stripped liquid into a second reaction stage operated in a cocurrent manner, in which it reacts with hydrogen under second stage catalytic conversion conditions, in the presence of a second catalyst selective for aromatics removal, to remove aromatic compounds and produce second stage liquid and vapor effluents, wherein said vapor effluent contains unreacted hydrogen and said liquid effluent contains a diesel boiling-range hydrocarbon fraction having a heteroatom and aromatics content lower than that of said hydroprocessed diesel fraction fed into the first reaction stage;

e) separating the second stage liquid and vapor effluents and recovering said second stage liquid effluent; and f) passing said second stage vapor effluent into said first stage, said two reaction stages and said stripping stage being in a common vessel.

11. A method according to claim 10 wherein said second stage vapor effluent supplies at least a portion of said hydrogen required for said first stage reaction.

12. A method according to claim 11 wherein said first and second stages operate at a pressure of at least 850 psia.

13. A method according to claim 12 wherein said second stage is located above said first stage and said second stage vapor is passed directly from said second stage, down into said first stage.

14. A method according to claim 13 wherein said stripping stage is located below said first reaction stage.

15. A method according to claim 14 wherein said second stage contains a catalyst comprising a noble metal catalytic component for aromatics removal.

16. A method according to claim 15 wherein said second stage also removes heteroatom compounds.

17. A method according to claim 16 wherein said first and second stages operate at a pressure of at least 950 psia.

18. A method according to claim 16 wherein said second stage vapor effluent supplies all of the hydrogen for said first stage for heteroatom removal.

19. A method according to claim 18 wherein either or both reaction stages are cooled or quenched to increase liquid yield.

20. A method according to claim 10 wherein the amount of diesel stock produced by said upgraded existing diesel hydrotreating facility is greater than that produced by said existing diesel hydrotreating.

* * * * *